US009556527B2

(12) United States Patent
Müller et al.

(10) Patent No.: US 9,556,527 B2
(45) Date of Patent: Jan. 31, 2017

(54) UNDIVIDED ELECTROLYTIC CELL AND USE OF THE SAME

(75) Inventors: Michael Müller, Holzkirchen (DE); Patrick Keller, Tyrlaching (DE); Markus Schiermeier, München (DE)

(73) Assignee: UNITED INITIATORS GMBH & CO. KG, Pullach (DE)

( * ) Notice: Subject to any disclaimer, the term of this patent is extended or adjusted under 35 U.S.C. 154(b) by 60 days.

(21) Appl. No.: 14/232,322

(22) PCT Filed: Jul. 13, 2012

(86) PCT No.: PCT/EP2012/063783

§ 371 (c)(1),
(2), (4) Date: Jan. 13, 2014

(87) PCT Pub. No.: WO2013/007816

PCT Pub. Date: Jan. 17, 2013

(65) Prior Publication Data

US 2014/0131218 A1 May 15, 2014

(30) Foreign Application Priority Data

Jul. 14, 2011 (EP) ..... 11173916

(51) Int. Cl.

| | |
|---|---|
| ***C25B 1/00*** | (2006.01) |
| ***C25B 1/28*** | (2006.01) |
| ***C25B 9/06*** | (2006.01) |

(52) U.S. Cl.
CPC *C25B 1/285* (2013.01); *C25B 9/06* (2013.01)

(58) Field of Classification Search
CPC ..... C25B 9/06; C25B 1/285
See application file for complete search history.

(56) References Cited

U.S. PATENT DOCUMENTS

| | | | | |
|---|---|---|---|---|
| 3,915,816 | A | 10/1975 | Rossberger | |
| 3,964,991 | A | 6/1976 | Sullins | |
| 3,984,303 | A | 10/1976 | Peters et al. | |
| 6,214,197 | B1 | 4/2001 | Kimizuka et al. | |
| 6,533,916 | B1 * | 3/2003 | Puetter | B82Y 30/00 204/290.01 |
| 2007/0187254 | A1 * | 8/2007 | Thiele | C25B 1/285 205/344 |
| 2015/0167183 | A1 | 6/2015 | Müller et al. | |

FOREIGN PATENT DOCUMENTS

| | | |
|---|---|---|
| CA | 1090286 | 11/1980 |
| CN | 1505699 | 6/2004 |

(Continued)

OTHER PUBLICATIONS

European Application No. 11173916.5, "Extended European Search Report" dated Sep. 1, 2011. International Application No. PCT/EP2012/063783 , International Preliminary Report on Patentability dated Jan. 14, 2014.
International Patent Application No. PCT/EP2012/063783 , "International Search Report", May 7, 2013.

(Continued)

*Primary Examiner* — Arun S Phasge
(74) *Attorney, Agent, or Firm* — Kilpatrick Townsend & Stockton LLP

(57) ABSTRACT

The invention relates to a method for producing an ammonium peroxydisulfate or alkali metal peroxydisulfate, to an undivided electrolytic cell which is composed of individual components, and to an electrolytic device composed of a plurality of said electrolytic cells.

22 Claims, 7 Drawing Sheets

(56) References Cited

FOREIGN PATENT DOCUMENTS

Figure 1:
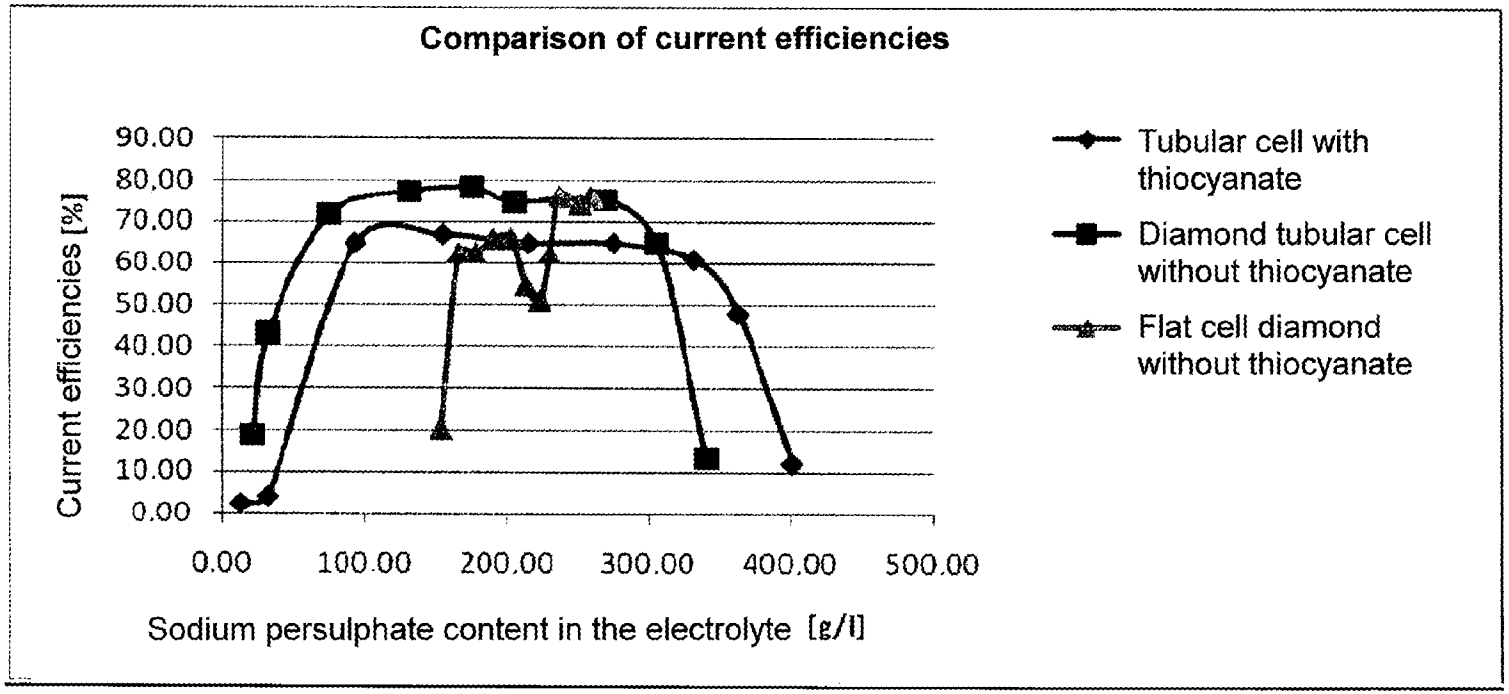

| | | |
|---|---|---|
| CN | 100591805 | 2/2010 |
| CN | 202144518 | 2/2012 |
| CN | 103827354 | 5/2014 |
| DE | 2757861 | 6/1978 |
| DE | 19913820 | 10/1999 |
| DE | 102009040651 | 4/2011 |
| EP | 428171 | 9/1993 |
| EP | 1148155 | 10/2001 |
| JP | 1977068872 | 6/1977 |
| JP | 2004099914 | 4/2004 |
| JP | 2008501856 | 1/2008 |
| TW | 524893 | 3/2003 |
| WO | 2005054545 | 6/2005 |
| WO | 2005121408 | 12/2005 |
| WO | 2011066632 | 6/2011 |

OTHER PUBLICATIONS

Japanese Patent Application No. 2014-519570, "Office Action", Feb. 29, 2016, 7 pages.
Michaud et al., "Preparation of Peroxodisulfuric Acid Using Boron-Doped Diamond Thin Film Electrodes", Electro Chemical and Solid-State Letters, 3(2) 77-79 (2000).
International Patent Application No. PCT/EP2013/064809 , International Search Report mailed Nov. 27, 2013.
U.S. Appl. No. 14/407,205 , "Non-Final Office Action", Oct. 7, 2015, 10 pages.
Chinese Patent Application No. CN201380031764.0, "Office Action", mailed May 9, 2016, 8 pages.
U.S. Appl. No. 14/407,205, "Non-Final Office Action", mailed Apr. 20, 2016, 8 pages.
Japanese Patent Application No. 2014519570, 2nd Office Action mailed Oct. 3, 2016 and English translation.

* cited by examiner

*Current densities:*

*The electrolyte was concentrated accordingly by being circulated*

UNDIVIDED ELECTROLYTIC CELL AND USE OF THE SAME

PRIOR RELATED APPLICATIONS

This application is a National Phase application of International Application No. PCT/EP2012/063783, filed Jul. 13, 2012, which claims priority to European Patent Application No. 11173916.5, filed Jul. 14, 2011, each of which is incorporated herein by reference in its entirety.

In one aspect the present invention relates to a process for the preparation of an ammonium or alkali metal peroxydisulphate.

It is known in the prior art to prepare alkali metal and ammonium peroxydisulphate by anodic oxidation of an aqueous solution comprising the corresponding sulphate or hydrogen sulphate and to obtain the salt thereby formed by crystallisation from the anolyte. Since in this process the decomposition voltage lies above the decomposition voltage of anodic formation of oxygen from water, a so-called promoter, conventionally thiocyanate as sodium or ammonium thiocyanate, is employed to increase the decomposition voltage of the water to oxygen (oxygen overvoltage) on a conventionally used platinum anode.

Rossberger (U.S. Pat. No. 3,915,816 (A)) describes a process for the direct preparation of sodium persulphate. In this context, undivided cells with platinum-coated anodes based on titanium are described as electrolytic cells. The current efficiencies described are based on addition of a potential-increasing promoter.

According to DE 27 57 861 sodium peroxydisulphate is prepared with a current efficiency of about 70 to 80% in an electrolytic cell with a cathode protected by a diaphragm and a platinum anode in that a neutral aqueous anolyte solution having an initial content of from 5 to 9 wt. % of sodium ions, 12 to 30 wt. % of sulphate ions, 1 to 4 wt. % of ammonium ions, 6 to 30 wt. % of peroxydisulphate ions and a potential-increasing promoter, such as, in particular, thiocyanate, is electrolysed using a sulphuric acid solution as the catholyte at a current density of at least 0.5 to 2 $A/cm^2$. After the peroxydisulphate has been crystallised out of and separated off from the anolyte, the mother liquor is mixed with the cathode product and the mixture is neutralised and fed back to the anode.

Disadvantages of this process are:

1. In order to reduce the evolution of oxygen, it is necessary to use a promoter.
2. In order to achieve the high current efficiencies described, it is necessary for the anode and cathode to be spatially separated by the use of a suitable membrane. The membranes required for this are very severely sensitive to abrasion.
3. The requirement of a high current density and therefore a high anode potential in order to obtain an economically acceptable current efficiency.
4. The problems associated with the production of the platinum anode, in particular with respect to obtaining a current efficiency which is acceptable for industrial purposes, and a long anode life. The continuous erosion of platinum, which can be present in the persulphate in an amount of up to 1 g/t of product, may be mentioned here by way of example. This erosion of platinum on the one hand has the effect of contaminating the product, and on the other hand leads to consumption of a valuable raw material, as a result of which last but not least the process costs are also increased.

5. The preparation of persulphates of low solubility product, essentially potassium and sodium persulphate, is possible in this way only in an extremely high dilution. This makes a high introduction of energy in the crystal formation necessary.
6. When the so-called conversion process is used, the persulphates prepared must be recrystallised from an ammonium persulphate solution. This results as a rule in a reduced or even a lack of purity of the product.

EP-B 0 428 171 discloses an electrolytic cell of the filter press type for the preparation of peroxy compounds, including ammonium peroxydisulphate, sodium peroxydisulphate and potassium peroxydisulphate. Platinum foils applied to a valve metal by the hot isostatic process are used as anodes here. A solution of the corresponding sulphate comprising a promoter and sulphuric acid is employed as the anolyte. This process also has the abovementioned problems.

In the process according to DE 199 13 820 peroxydisulphates are prepared by anodic oxidation of an aqueous solution comprising neutral ammonium sulphate. For the purpose of preparation of sodium or potassium peroxydisulphate, the solution obtained from the anodic oxidation, which comprises ammonium peroxydisulphate, is reacted with sodium hydroxide solution or potassium hydroxide solution. After the corresponding alkali metal peroxydisulphate has been crystallised and separated off, the mother liquid is recycled in a mixture with the catholyte produced during the electrolysis. In this process also, the electrolysis is carried out in the presence of a promoter on a platinum electrode as the anode.

Although peroxydisulphates have already been obtained on an industrial scale by anodic oxidation on a platinum anode for decades, these processes continue to have serious disadvantages (see also the above list). An addition of promoters, also called polarisers, is always necessary in order to increase the oxygen overvoltage and to improve the current efficiency. As oxidation products of these promoters, which unavoidably form as by-products during the anodic oxidation, toxic substances enter into the anode waste gas and must be removed in a gas wash. High current efficiencies furthermore require a separation of anolyte and catholyte. The anodes, which are conventionally covered with platinum over the entire surface, always require a high current density. A current load thereby occurs on the anolyte volume, the separator and the cathode, as a result of which additional measures become necessary to lower the cathodic current density by a three-dimensional structuring of the electrolytic cell and an activation. There is also a high thermal load on the labile peroxydisulphate solution. In order to minimise this load, construction measures must be taken, and the outlay on cooling additionally increases. Because of the limited removal of heat, the electrode surface must be limited, and with this the outlay on installation per cell unit increases. In order to overcome the high current load, as a rule electrode support materials with high heat transfer properties must additionally be used, which in their turn are susceptible to corrosion and expensive.

P. A. Michaud et al. teach in Electrochemical and Solid State Letters, 3(2) 77-79 (2000) the preparation of peroxydisulphuric acid by anodic oxidation of sulphuric acid using a diamond thin film electrode doped with boron. This document teaches that such electrodes have a higher overvoltage for oxygen than platinum electrodes. However, the publication gives no indication of the industrial preparation of ammonium and alkali metal peroxydisulphates using diamond thin film electrodes doped with boron. In this context it is in fact known that sulphuric acid on the one hand and hydrogen sulphates, in particular neutral sulphates, on the other hand behave very differently during anodic oxidation. In spite of the increased overvoltage of oxygen at the diamond electrode doped with boron, the main side reaction in addition to the anodic oxidation of sulphuric acid is the evolution of oxygen and additionally of ozone.

In the course of their invention described in the patent EP 1148155 B1, Stenner and Lehmann already realised in 2001 that when a diamond-coated, divided electrolytic cell is used for the preparation of persulphates, no additional promoter is necessary in order nevertheless to achieve such high current efficiencies. A disadvantage of this process is, above all due to the sensitive separators, as already described above, that the preparation of persulphates of low solubility product, essentially potassium and sodium persulphate, is possible only with an extremely high dilution, that is to say below the solubility limit, which requires a high introduction of energy during the crystal formation and the discharge of salt in the course of the evaporation and drying.

Accordingly, it is an object of the present invention to provide an industrial process for the preparation of ammonium and alkali metal peroxydisulphates which avoids the disadvantages of the known processes or at least still has them only to a lesser extent and renders possible the use of a diamond-coated, undivided cell for the preparation of persulphates, in particular those of low solubility potential in electrolyte solutions or electrolyte suspensions comprising sulphate and sulphuric acid, so that in addition to the electrochemical advantages demonstrated in the course of this invention, in particular also the mechanical and abrasive properties already known from other uses of a diamond-coated carrier are also rendered usable for the electrochemical oxidation of sulphates in suspensions, as described above.

To achieve this object, the present application accordingly provides a process for the preparation of an ammonium or alkali metal peroxydisulphate, comprising an anodic oxidation of an aqueous electrolyte comprising a salt from the series of ammonium sulphate, alkali metal sulphate and/or the corresponding hydrogen sulphate in an electrolytic cell, comprising at least one anode and one cathode, wherein a diamond layer arranged on a conductive carrier and doped with a tri- or pentavalent element is used as the anode, wherein the electrolytic cell comprises an undivided electrolyte chamber between the anode and the cathode and the aqueous electrolyte comprises no promoter for increasing the decomposition voltage of water to oxygen.

The salt from the series of ammonium sulphate, alkali metal sulphate and/or the corresponding hydrogen sulphates employed for the anodic oxidation can be any desired alkali metal sulphate or corresponding hydrogen sulphate. In the context of the present application, however, the use of sodium and/or potassium sulphate and/or the corresponding hydrogen sulphate is particularly preferred.

"Promoter" or also "polariser" in the context of the present invention is any desired agent which is known to the person skilled in the art as an addition when carrying out an electrolysis for increasing the decomposition voltage of water to oxygen or for improving the current efficiency. An example of such a promoter used in the prior art is thiocyanate, such as, for example, sodium or ammonium thiocyanate. Such a promoter is not used according to the invention. In other words, the electrolyte in the process according to the invention has a promoter concentration of 0 g/l. By dispensing with a promoter during the process, purification requirements relating to the typical electrolytic gases formed, for example, are absent.

An anode which comprises a diamond layer arranged on a conductive carrier and doped with a 3- or 5-valent element is employed in the process according to the invention. An advantage of this feature lies in the very high wear resistance of the diamond coating. Long-term studies have shown that such electrodes achieve a minimum age of more than 12 years.

The anode employed can be of any desired form.

In this context any desired anode carrier material known to the person skilled in the art can be used. In a preferred embodiment in the present invention, the carrier material is chosen from the group consisting of silicon, germanium, titanium, zirconium, niobium, tantalum, molybdenum, tungsten, carbides of these elements and/or aluminium or combinations of the elements.

The diamond layer doped with a 3- or 5-valent element is applied to this carrier material. The doped diamond layer is thus an n-conductor or a p-conductor. In this context it is preferable for a boron-doped and/or phosphorus-doped diamond layer to be employed. The amount of the doping is adjusted such that the desired, as a rule just sufficient, conductivity is achieved. For example, in the case of doping with boron the crystal structure can comprise up to 10,000 ppm of boron.

The diamond layer can be applied over the entire area or in portions, such as, for example, exclusively to the front or exclusively to the reverse of the carrier material.

Processes for application of the diamond layer are known to the person skilled in the art. The preparation of the diamond electrodes can be carried out in particular in two specific CVD processes (chemical vapour deposition technique). These are the microwave plasma CVD and the hot wire CVD process. In both cases the gas phase, which is activated to the plasma by microwave irradiation or thermally by hot wires, is formed from methane, hydrogen and optionally further additions, in particular a gaseous compound of the doping agent.

By using a boron compound, such as trimethylborane, a p-semiconductor can be provided. By employing a gaseous phosphorus compound as the doping agent, an n-semiconductor is obtained. By deposition of the doped diamond layer on crystalline silicon, a particularly dense and pore-free layer is obtained—a film thickness of about 1 μm is conventionally sufficient. In this context the diamond layer is preferably applied to the anode carrier material employed according to the invention in a film thickness of from about 0.5 μm to 5 μm, preferably about 0.8 μm to about 2.0 μm and particularly preferably about 1.0 μm.

As an alternative to the deposition of the diamond layer on a crystalline material, the deposition can also be carried out on a self-passivating metal, such as, for example, titanium, tantalum, tungsten or niobium. The abovementioned article by P. A. Michaud is referred to for the production of a particularly suitable boron-doped diamond layer on a silicon monocrystal.

In the context of the present invention the use of an anode comprising a niobium or titanium carrier having a boron-doped diamond layer, in particular a diamond layer boron-doped up to the extent of 10,000 ppm in the crystal structure, is particularly preferred.

The cathode employed in the process according to the invention is preferably formed from lead, carbon, tin, platinum, nickel, alloys of these elements, zirconium and/or acid-resistant high-grade steels, such as are known to the person skilled in the art. Three-dimensionally, the cathode can have any desired configuration.

In the electrolytic cell employed according to the invention the electrolyte chamber is undivided between the anode and cathode, i.e. there is no separator between the anode and cathode. The use of an undivided cell renders possible electrolyte solutions having very high solids concentrations, as a result of which in turn the expenditure of energy in the obtaining of the salt, essentially the crystallisation and the evaporation of water, is significantly reduced, but at least to 25% of that of a divided cell, directly proportionally to the increase in the solids content.

In preferred embodiments, the process according to the invention is carried out in a two-dimensional or three-dimensional cell. In this context the cell is preferably constructed as a flat or tubular cell.

In particular, the use of a tube geometry, that is to say a tubular cell comprising an inner tube as the anode, preferably of diamond-coated niobium, and an outer tube as the cathode, preferably of acid-resistant high grade steel, represents an advantageous construction with simultaneously low material costs. The use of an annular gap as a common electrolyte chamber is preferred and leads to a flow which is uniform and therefore is low in flow losses, and therefore to a high utilisation of the electrolytic surfaces available, which in turn means a high current efficiency. The production costs of such a cell are low in relation to a so-called flat cell.

In a preferred embodiment of the process according to the invention, several electrolytic cells are combined, preferably in the form of a double tube package or two-dimensionally.

The electrolyte employed in the process according to the invention preferably has an acidic, preferably sulphuric acid, or neutral pH.

In a further preferred embodiment of the invention, the electrolyte is moved in circulation through the electrolytic cell during the process. As a result, a high electrolyte temperature in the cell which accelerates the decomposition of the persulphates, and is thus undesirable, is prevented.

In a further preferred embodiment, the process comprises a sluicing out of electrolyte solution from the electrolyte circulation. This can be carried out, in particular, to obtain the peroxydisulphate produced. A further preferred embodiment therefore relates to a procedure in which the peroxydisulphates produced are obtained by crystallisation and separating off of the crystals from the electrolyte solution to form an electrolyte liquor, the electrolyte solution preferably having been sluiced out of the electrolyte circulation beforehand. A further preferred embodiment comprises a recirculation of the electrolyte mother liquor, in particular if peroxydisulphates produced have been separated off beforehand, increasing the content of acid, sulphate and/or hydrogen sulphate in the electrolytic cell.

According to the invention, the anodic oxidation is preferably carried out at an anodic current density of 50-1,500 $mA/cm^2$ and more preferably about 50-1,200 $mA/cm^2$. A current density which is particularly preferably used lies in the range of 60-975 $mA/cm^2$.

The electrolyte employed in the process according to the invention preferably has a total solids content of from about 0.5 to 650 g/l. The (working) electrolyte preferably comprises about 100 to about 500 g/l of persulphate, more preferably about 150 to about 450 g/l and most preferably 250-400 g/l. The process according to the invention thus renders possible in particular high solids concentrations in the electrolyte solution, without addition of a potential-increasing agent or promoter and the resulting requirement of waste gas and waste water treatment, with simultaneously high current efficiencies during the peroxydisulphate preparation.

The electrolyte solution furthermore preferably comprises about 0.1 to about 3.5 mol of sulphuric acid per liter (l) of electrolyte solution, more preferably 1-3 mol of sulphuric acid per l of electrolyte solution and most preferably 2.2-2.8 mol of sulphuric acid per l of electrolyte solution.

In summary, an electrolyte having the following composition is particularly preferably used in the process according to the invention: per liter of electrolyte 150 to 500 g of persulphate and 0.1 to 3.5 mol of sulphuric acid per mol of electrolyte solution. The total solids content is preferably 0.5 g/l to 650 g/l, more preferably 100-500 g/l and most preferably 250-400 g/l, the sulphate content varying in this context. The promoter content is 0 g/l.

The invention furthermore relates to an undivided electrolytic cell built up from individual components, an electrolytic device built up from several such electrolytic cells, and the use thereof for the oxidation of an electrolyte.

"Electrolysis" is understood as meaning a chemical change which is caused by passage of current through an electrolyte and manifests itself in a direct conversion of electrical energy into chemical energy by the mechanism of the electrode reactions and ionic migration. Certainly the most important electrochemical reaction industrially is the electrolysis of sodium chloride solution, in which sodium hydroxide solution and chlorine gas are formed. The preparation of inorganic peroxides is nowadays carried out on a large industrial scale in electrolytic cells.

In large-scale industrial processes it is desirable in particular to be able to conduct the reactions at high concentrations of educts and, correspondingly, products. High product concentrations ensure easy working up of the end product, since in the case of reaction products in solution the solvent must be removed. In the electrolysis of highly concentrated electrolytes, the expenditure of energy in the subsequent working up of the electrolytic products can thus also be lowered.

Uses with very high solids contents, nevertheless, make high demands on the components of the electrolytic cell due to the abrasive action of the electrolyte. In particular the diaphragm, which prevents a mixing of the reaction products of the anode and cathode chamber in divided electrolytic cells, does not withstand electrolytic processes at high concentrations in the long term. At high solids contents an electrolysis can therefore be carried out only in undivided cells, in which the anode chamber and the cathode chamber do not have to be spatially separated by using a suitable membrane. Such undivided cells are employed in particular if neither educts nor products which are prepared at the anode or cathode are changed or react with one another in an interfering manner due to the other particular electrode process.

The anode and cathode materials must furthermore also meet the mechanical requirements at high solids concentrations and therefore be extremely wear-resistant.

In order to design the electrolysis as economically as possible, the electrolytic cells must be configured such that the electrolysis can be carried out at the highest possible current densities. This is only possible if the anode and cathode have a good electrical conductivity and are chemically inert with respect to the electrolyte. Graphite or platinum is conventionally used as the anode material. Nevertheless, these materials have the disadvantage that at high solids concentrations they do not have an adequate abrasion resistance.

The production of electrodes which are mechanically extremely stable and inert is disclosed in DE 199 11 746. In this context, electrodes are coated with an electrically conductive diamond layer, the diamond layer being applied by a chemical gas deposition process (CVD).

The object of the present invention is to provide an electrolytic cell which renders possible a continuous and optimised electrolytic process at high solids concentrations (up to about 650 g/l) and in high current density ranges (up to about 1,500 mA/cm$^2$). The electrolytic cell should be matched to the electrochemical reactions to be carried out and individual components should be easily replaceable without the actual cell body being destroyed.

Surprisingly, it has been possible to achieve the object by an electrolytic cell comprising the components:

(a) at least one tubular cathode, (b) at least one rod-shaped or tubular anode which comprises a conductive carrier coated with a conductive diamond layer, (c) at least one inlet tube, (d) at least one outlet tube and (e) at least one distributor device.

Preferably, in the electrolytic cell the anode and cathode are arranged concentrically with respect to one another, so that the electrolyte chamber is preferably formed as an annular gap between the anode lying inside and the cathode lying outside. In this embodiment the diameter of the cathode is thus greater than that of the anode.

In a preferred embodiment, the electrolyte chamber comprises no membrane or diaphragm. This case is an electrolytic cell with a common electrolyte chamber, i.e. the electrolytic cell is undivided.

Preferably, the distance between the anode outer surface and the cathode inner surface is between 1-20 mm, more preferably between 1-15 mm, still more preferably between 2-10 mm and most preferably between 2-6 mm.

The internal diameter of the cathode is preferably between 10-400 mm, more preferably between 20-300 mm, still more preferably between 25-250 mm.

In a preferred embodiment, the anode and cathode are each independently of each other between 20-120 cm long, more preferably between 25-75 cm long.

The length of the electrolyte chamber is preferably at least 20 cm, more preferably at least 25 cm, and a maximum of preferably 120 cm, more preferably 75 cm.

The cathode employed according to the invention is preferably made of lead, carbon, tin, platinum, nickel, alloys of these elements, zirconium and/or iron alloys, in particular of high-grade steel, in particular acid-resistant high-grade steel. In a preferred embodiment, the cathode is made of acid-resistant high-grade steel.

The base material of the rod-shaped or tubular, preferably tubular, anode is preferably silicon, germanium, titanium, zirconium, niobium, tantalum, molybdenum, tungsten, carbides of these elements and/or aluminium, or combinations of the elements.

The anode carrier material can be identical to the anode base material or different. In a preferred embodiment, the anode base material functions as a conductive carrier. Any desired conductive material known to the person skilled in the art can be used as the conductive carrier. Particularly preferred carrier materials are silicon, germanium, titanium, zirconium, niobium, tantalum, molybdenum, tungsten, carbides of these elements and/or aluminium, or combinations of the elements. Silicon, titanium, niobium, tantalum, tungsten or carbides of these elements are particularly preferably used as the conductive carrier, more preferably niobium or titanium, still more preferably niobium.

A conductive diamond layer is applied to this carrier material. The diamond layer can be doped with at least one 3- or at least one 5-valent main group or sub-group element. The doped diamond layer is thus an n-conductor or a p-conductor. In this context it is preferable for a boron-doped and/or phosphorus-doped diamond layer to be employed. The amount of the doping is adjusted such that the desired, as a rule just sufficient, conductivity is achieved. For example, in the case of doping with boron the crystal structure can comprise up to 10,000 ppm, preferably from 10 ppm to 2,000 ppm, of boron and/or phosphorus.

The diamond layer can be applied over the entire surface or in portions, preferably over the entire outer surface, of the rod-shaped or tubular anode. Preferably, the conductive diamond layer is pore-free.

Processes for application of the diamond layer are known to the person skilled in the art. The production of the diamond electrodes can be carried out in particular in two specific CVD processes (Chemical Vapour Deposition). These are the microwave plasma CVD and the hot wire CVD process. In both cases the gas phase, which is activated to the plasma by a microwave irradiation or thermally by hot wires, is formed from methane, hydrogen and optionally further additions, in particular a gaseous compound of the doping agent.

By using the boron compound, such as trimethylborane, a p-semiconductor can be provided. By employing a gaseous phosphorus compound as the doping agent, an n-semiconductor is obtained. By deposition of the doped diamond layer on crystalline silicon, a particularly dense and pore-free layer is obtained. In this context the diamond layer is preferably applied to the conductive carrier used according to the invention in a film thickness of about 0.5-5 μm, preferably about 0.8-2.0 μm and particularly preferably about 1.0 μm. In another embodiment, the diamond layer is preferably applied to the conductive carrier used according to the invention in a film thickness of 0.5-35 μm, preferably 5-25 μm, most preferably 10-20 μm.

As an alternative to the deposition of the diamond layer on a crystalline material, the deposition can also be carried out on a self-passivating metal, such as, for example, titanium, tantalum, tungsten or niobium. Reference is made to P. A. Michaud (Electrochemical and Solid State Letters, 3(2) 77-79 (2000)) for the production of a particularly suitable boron-doped diamond layer on a silicon monocrystal.

In the context of the present invention the use of an anode comprising a niobium or titanium carrier having a boron-doped diamond layer, in particular having a diamond layer boron-doped up to the extent of 10,000 ppm, is particularly preferred.

The diamond-coated electrodes are distinguished by a very high mechanical strength and abrasion resistance.

Preferably, the anode and/or the cathode, more preferably the anode and the cathode, still more preferably the anode, is connected to the current source via the distributor device. In the case where the anode and cathode are connected to the current source via the distributor device, it must be ensured that the distributor device is correspondingly electrically insulated. In any case, a good electrical contact between the anode and/or cathode and the distributor device is to be ensured.

The distributor device furthermore ensures homogeneous feeding of the electrolyte from the inlet tube into the electrolyte chamber. After the electrolyte has passed through the electrolyte chamber, the electrolyte which has reacted (electrolytic product) is effectively collected with the aid of at least one distributor device located upstream and removed via an outlet tube.

The distributor devices according to the invention independently of each other are preferably made of silicon, germanium, titanium, zirconium, niobium, tantalum, molybdenum, tungsten, carbides of these elements and/or aluminium or combinations of the elements, particularly preferably of titanium.

The distributor devices preferably have at least one connection point for at least one outlet or inlet tube and a connection point for the anode. The connection point for the anode forms a hollow cylinder, which is closed if appropriate and which ends flush with the anode tube or rod. In the case of tubular anodes, the hollow cylinder in the distributor devices can close off the anode tube tightly, so that no electrolyte can enter into the inside of the anode. Alternatively, the connection point of the distributor device on the anode can have a relief bore into the anode tube. This prevents electrolyte from being able to flow out into the anode tube if the pressures on the distributor element are too high.

The hollow cylinder, which is closed if appropriate, of the distributor device can be attached to the carrier material of the anode or also directly to the diamond-coated carrier. In the latter case the carrier and the distributor device are thus separated from one another by the conductive diamond layer. In a particularly preferred embodiment, the distributor device is connected irreversibly, particularly preferably welded, to the anode. This is advantageous in particular if work is carried out at high current strengths. For example, the anode and the distributor device can be welded by diffusion welding, electron beam welding or laser welding.

Radial bores are distributed over the periphery of the hollow cylinder of the distributor device. Preferably, the distributor device has 3, more preferably 4 and still more preferably 5 radial bores. By the radial bores in the distributor device the electrolyte can be distributed homogeneously and in a flow-assisted manner into the electrolyte chamber, and the electrolytic product can be removed effectively after passage through the electrolyte chamber.

The electrolyte is preferably fed to the electrolytic cell and in particular the distributor device via the inlet tube. The electrolytic product is preferably removed from the electrolytic cell via the outlet tube, in particular after the electrolytic product has been collected in the distributor device.

In a preferred embodiment the distributor device is configured such that it tightly closes the tubular cathode, so that no electrolyte or electrolytic product can emerge from the cathode.

The distributor device fulfils several tasks independently of each other:

- sealing of the tubular anode so that no electrolyte can enter into the anode interior or pressure regulation by the relief bore in the anode chamber and/or
- electrical contacting of the anode and/or cathode with the current source and/or
- homogeneous distribution in a flow-assisted manner of the electrolyte in the electrolytic chamber (optimum hydraulic distribution over the entire exchange area) and/or
- effective removal of the electrolytic product from the electrolyte chamber and/or
- sealing of the tubular cathode and/or
- reduction of the flow losses.

The components anode, cathode, distributor device, inlet and outlet tube can be assembled into an electrolytic cell by corresponding assembly devices known to the person skilled in the art.

Due to the modular construction of the anode, cathode, distributor device, inlet and outlet tube, the individual components can be formed in various materials and exchanged or replaced individually if damaged. The diamond anode according to the invention and the other components, which are produced from less expensive materials, have thus successfully been combined with one another in a simple manner to give an electrolytic cell which is very compact in construction.

The tubular electrolytic cell is moreover distinguished by a high strength with a simultaneously low use of materials. Parts which wear in time, for example due to the abrasively acting electrolytes, can be replaced individually, so that an economical use of materials is also ensured in this respect. In the tubular electrolytic cell the electrolyte flows into the electrolyte chamber in a flow-assisted manner, as a result of which flow losses are avoided and the surface can be used to the optimum for the electrochemical exchange of material. A continuous and homogeneous electrolytic process at high solids concentrations and current density ranges is possible due to the electrode materials and electrode arrangement.

A further aspect of the present invention is an electrolytic device which comprises at least two electrolytic cells according to the invention, wherein the electrolyte flows through the electrolytic cells in succession and the electrolytic cells are operated electrochemically connected in parallel. The installation capacities are thus flexible and can be implemented without limits.

The electrolytic cell according to the invention or the electrolytic device according to the invention is suitable in particular for the oxidation of an electrolyte. As stated above, the undivided electrolytic cell is suitable in particular for oxidation of an electrolyte if neither electrolyte products nor electrolytic products which are prepared or reacted at the anode or cathode are changed or react with one another in an interfering manner due to the other particular electrode process.

The electrolytic cells according to the invention can be operated with a current density of between 50-1,500 $mA/cm^2$, preferably 50-1,200 $mA/cm^2$, more preferably 60-975 $mA/cm^2$ and thus render possible large scale industrial and economical processes.

The electrolytic cells/electrolytic devices according to the invention can moreover be employed at very high solids contents of between 0.5-650 g/l, preferably 100-500 g/l, more preferably 150-450 g/l and still more preferably 250-400 g/l.

The electrolytic cells/devices according to the invention are suitable in particular for the anodic oxidation of sulphate to peroxydisulphate.

The electrolytic cells/electrolytic devices according to the invention have proved themselves in particular for the preparation of peroxydisulphates.

It is known in the prior art to prepare alkali metal and ammonium peroxydisulphate by anodic oxidation of an aqueous solution comprising the corresponding sulphate or hydrogen sulphate and to obtain the salt thereby formed by crystallisation from the anolyte. Since in this process the decomposition voltage lies above the decomposition voltage of anodic formation of oxygen from water, a so-called promoter or polariser, conventionally thiocyanate as sodium or ammonium thiocyanate, is employed to increase the decomposition voltage of the water to oxygen (oxygen overvoltage) on a conventionally used platinum anode.

Rossberger (U.S. Pat. No. 3,915,816 (A)) describes a process for the direct preparation of sodium persulphate. In this context, undivided cells with platinum-coated anodes based on titanium are described as electrolytic cells. The current efficiencies described are based on addition of a potential-increasing promoter.

According to DE 27 57 861 sodium peroxydisulphate is prepared with a current efficiency of about 70 to 80% in an electrolytic cell with a cathode protected by a diaphragm and a platinum anode in that a neutral aqueous anolyte solution having an initial content of from 5 to 9 wt. % of sodium ions, 12 to 30 wt. % of sulphate ions, 1 to 4 wt. % of ammonium ions, 6 to 30 wt. % of peroxydisulphate ions and a potential-increasing promoter, such as, in particular, thiocyanate, is electrolysed using a sulphuric acid solution as the catholyte at a current density of at least 0.5 to 2 $A/cm^2$. After the peroxydisulphate has been crystallised out of and separated off from the anolyte, the mother liquor is mixed with the cathode product and the mixture is neutralised and fed back to the anode.

Disadvantages of this process are:

1. In order to reduce the evolution of oxygen, it is necessary to use a promoter.
2. In order to achieve the high current efficiencies described, it is necessary for the anode and cathode to be spatially separated by the use of a suitable membrane. The membranes required for this are very severely sensitive to abrasion.
3. The requirement of a high current density and therefore a high anode potential in order to obtain an economically acceptable current efficiency.
4. The problems associated with the production of the platinum anode, in particular with respect to obtaining a current efficiency which is acceptable for industrial purposes, and a long anode life. The continuous erosion of platinum, which can be present in the persulphate in an amount of up to 1 g/t of product, may be mentioned here by way of example. This erosion of platinum on the one hand has the effect of contaminating the product, and on the other hand leads to consumption of a valuable raw material, as a result of which not least the process costs are also increased.
5. The preparation of persulphates of low solubility product, essentially potassium and sodium persulphate, is possible in this way only in an extremely high dilution. This makes a high introduction of energy in the crystal formation necessary.
6. When the so-called conversion process is used, the persulphates prepared must be recrystallised from an ammonium persulphate solution. This results as a rule in a reduced or even a lack of purity of the product.

EP-B 0 428 171 discloses an electrolytic cell of the filter press type for the preparation of peroxy compounds, including ammonium peroxydisulphate, sodium peroxydisulphate and potassium peroxydisulphate. Platinum foils applied to a valve metal by the hot isostatic process are used as anodes here. A solution of the corresponding sulphate comprising a promoter and sulphuric acid is employed as the anolyte. This process also has the abovementioned problems.

In the process according to DE 199 13 820 peroxydisulphates are prepared by anodic oxidation of an aqueous solution comprising neutral ammonium sulphate. For the purpose of preparation of sodium or potassium peroxydisulphate, the solution obtained from the anodic oxidation, which comprises ammonium peroxydisulphate, is reacted with sodium hydroxide solution or potassium hydroxide solution. After the corresponding alkali metal peroxydisulphate has been crystallised and separated off, the mother liquid is recycled in a mixture with the catholyte produced during the electrolysis. In this process also, the electrolysis is carried out in the presence of a promoter on a platinum electrode as the anode.

Although peroxydisulphates have already been obtained on an industrial scale by anodic oxidation on a platinum anode for decades, these processes continue to have serious disadvantages (see also the above list). An addition of promoter, also called polariser, is always necessary in order to increase the oxygen overvoltage and to improve the current efficiency. As oxidation products of these promoters, which unavoidably form as by-products during the anodic oxidation, toxic substances enter into the anode waste gas and must be removed in a gas wash. High current efficiencies furthermore require a separation of anolyte and catholyte. The anodes, which are conventionally covered with platinum over the entire surface, always require a high current density. A current load thereby occurs on the anolyte volume, the separator and the cathode, as a result of which additional measures become necessary to lower the cathodic current density by a three-dimensional structuring of the electrolytic cell and an activation. There is also a high thermal load on the labile peroxydisulphate solution. In order to minimise this load, construction measures must be taken, and the outlay on cooling additionally increases. Because of the limited removal of heat, the electrode surface must be limited, and with this the outlay on installation per cell unit increases. In order to overcome the high current load, as a rule electrode support materials with high heat transfer properties must additionally be used, which are, for their part, susceptible to corrosion, and expensive.

P. A. Michaud et al. teach in Electrochemical and Solid State Letters, 3(2) 77-79 (2000) the preparation of peroxydisulphuric acid by anodic oxidation of sulphuric acid using a diamond thin film electrode doped with boron. This document teaches that such electrodes have a higher overvoltage for oxygen than platinum electrodes. However, the publication gives no indication of the industrial preparation of ammonium and alkali metal peroxydisulphates using diamond thin film electrodes doped with boron. In this context it is in fact known that sulphuric acid on the one hand and hydrogen sulphates, in particular neutral sulphates, on the other hand behave very differently during anodic oxidation. In spite of the increased overvoltage of oxygen at the diamond electrode doped with boron, the main side reaction in addition to the anodic oxidation of sulphuric acid is the evolution of oxygen and additionally of ozone.

In the course of their invention described in the patent EP 1148155 B1, Stenner and Lehmann already realised in 2001 that when a diamond-coated, divided electrolytic cell is used for the preparation of persulphates, no additional promoter is necessary in order nevertheless to achieve such high current efficiencies. A disadvantage of this process is, above all due to the sensitive separators, as already described above, that the preparation of persulphates of low solubility product, essentially potassium and sodium persulphate, is possible only with an extremely high dilution, that is to say below the solubility limit, which requires a high introduction of energy during the crystal formation and the discharge of salt in the course of the evaporation and drying.

The salt from the series of ammonium sulphate, alkali metal sulphate and/or the corresponding hydrogen sulphates employed for the anodic oxidation can be any desired alkali metal sulphate or corresponding hydrogen sulphate. In the context of the present application, however, the use of sodium and/or potassium sulphate and/or the corresponding hydrogen sulphate is particularly preferred.

In the electrolytic cell employed according to the invention, the electrolyte chamber is undivided between the anode and cathode, i.e. there is no separator between the anode and cathode. The use of an undivided cell renders possible electrolyte solutions having very high solids concentrations, as a result of which in turn the expenditure of energy in the obtaining of the salt, essentially the crystallisation and the evaporation of water, is significantly reduced, but at least to 25% of that of a divided cell, directly proportionally to the increase in the solids content. The use of a promoter is also not necessary according to the invention.

"Promoter" in the context of the present invention is any desired agent which is known to the person skilled in the art as an addition when carrying out an electrolysis for increasing the decomposition voltage of water to oxygen or for improving the current efficiency. An example of such a promoter used in the prior art is thiocyanate, such as, for example, sodium or ammonium thiocyanate.

The electrolyte employed preferably has an acidic, preferably sulphuric acid, or neutral pH.

The electrolyte can be moved in circulation through the electrolytic cell during the process. As a result, a high electrolyte temperature in the cell which accelerates the decomposition of the persulphates and is thus undesirable is prevented.

A sluicing out of electrolyte solution from the electrolyte circulation is carried out to obtain the peroxydisulphate produced. The peroxydisulphate produced can be obtained by crystallisation and separating off of the crystals from the electrolyte solution to form an electrolyte liquor.

At the start of the electrolysis the electrolyte employed preferably has a total solids content of from about 0.5 to 650 g/l. At the start of the reaction the electrolyte preferably comprises about 100 to about 500 g/l of sulphate, more preferably about 150 to 450 g/l of sulphate and most preferably 250-400 g/l of sulphate. The use of the electrolytic cell/device according to the invention thus renders possible high solids concentrations in the electrolyte solution, without addition of a potential-increasing agent or promoter and the resulting requirements of waste gas and waste water treatment, with simultaneously high current efficiencies during the peroxydisulphate preparation.

The electrolyte solution furthermore preferably comprises about 0.1 to about 3.5 mol of sulphuric acid per liter (I) of electrolyte solution, more preferably 1-3 mol of sulphuric acid per I of electrolyte solution and most preferably 2.2-2.8 mol of sulphuric acid per I of electrolyte solution.

In summary, an electrolyte having the following composition is particularly preferably used in the process according to the invention: per liter of starting electrolyte 150 to 500 g of sulphate and 0.1 to 3.5 mol of sulphuric acid per I of electrolyte solution. The total solids content is preferably 0.5 g/l to 650 g/l, more preferably 100-500 g/l and most preferably 250-400 g/l. The promoter content is 0 g/l.

FIGURES

FIG. 1: Comparison of current efficiencies of different cell types with and without rhodanide (promoter)

Figure 2A:
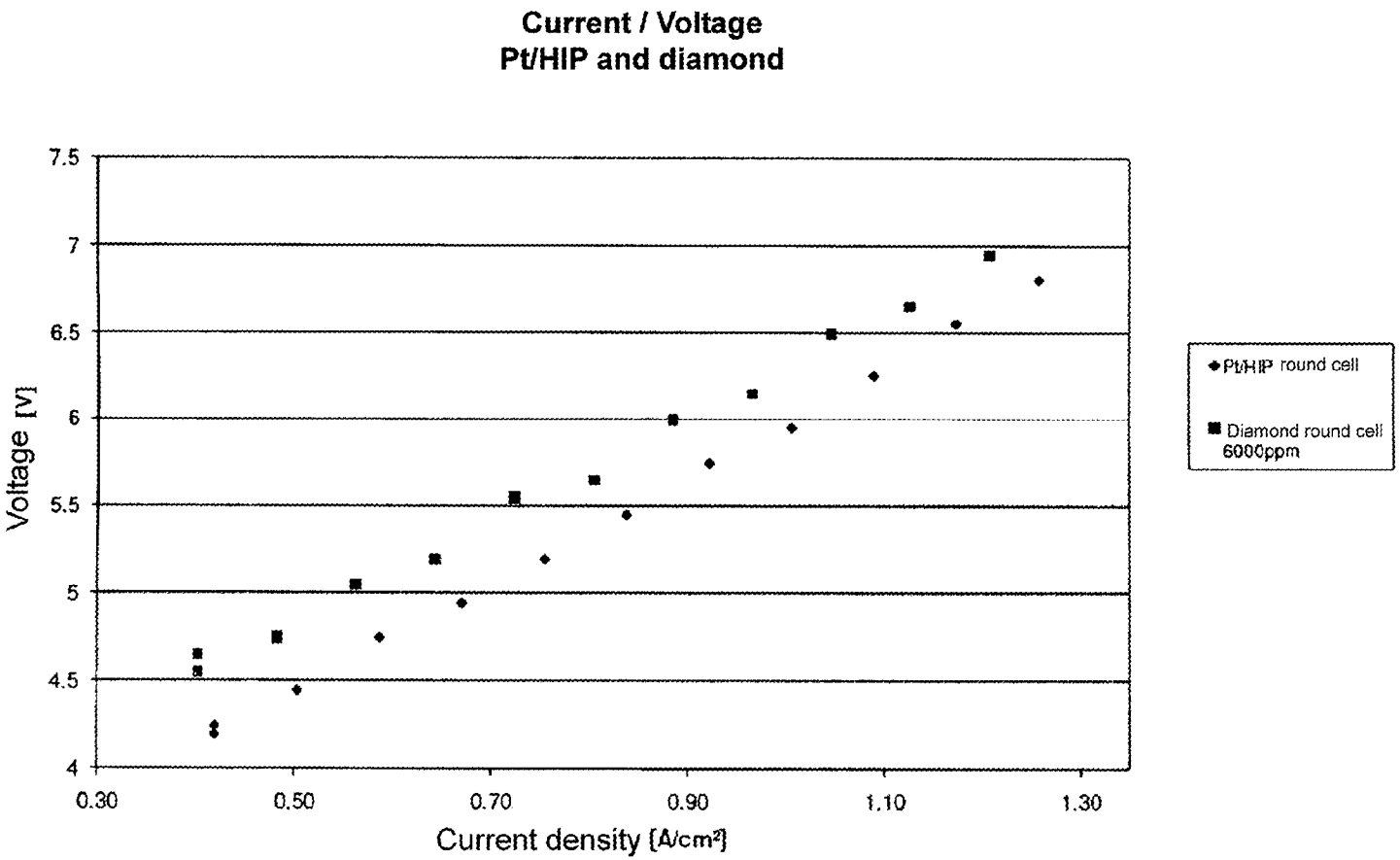

FIG. 2*a*: Current/voltage in Pt/HIP and diamond electrodes

Figure 2B:
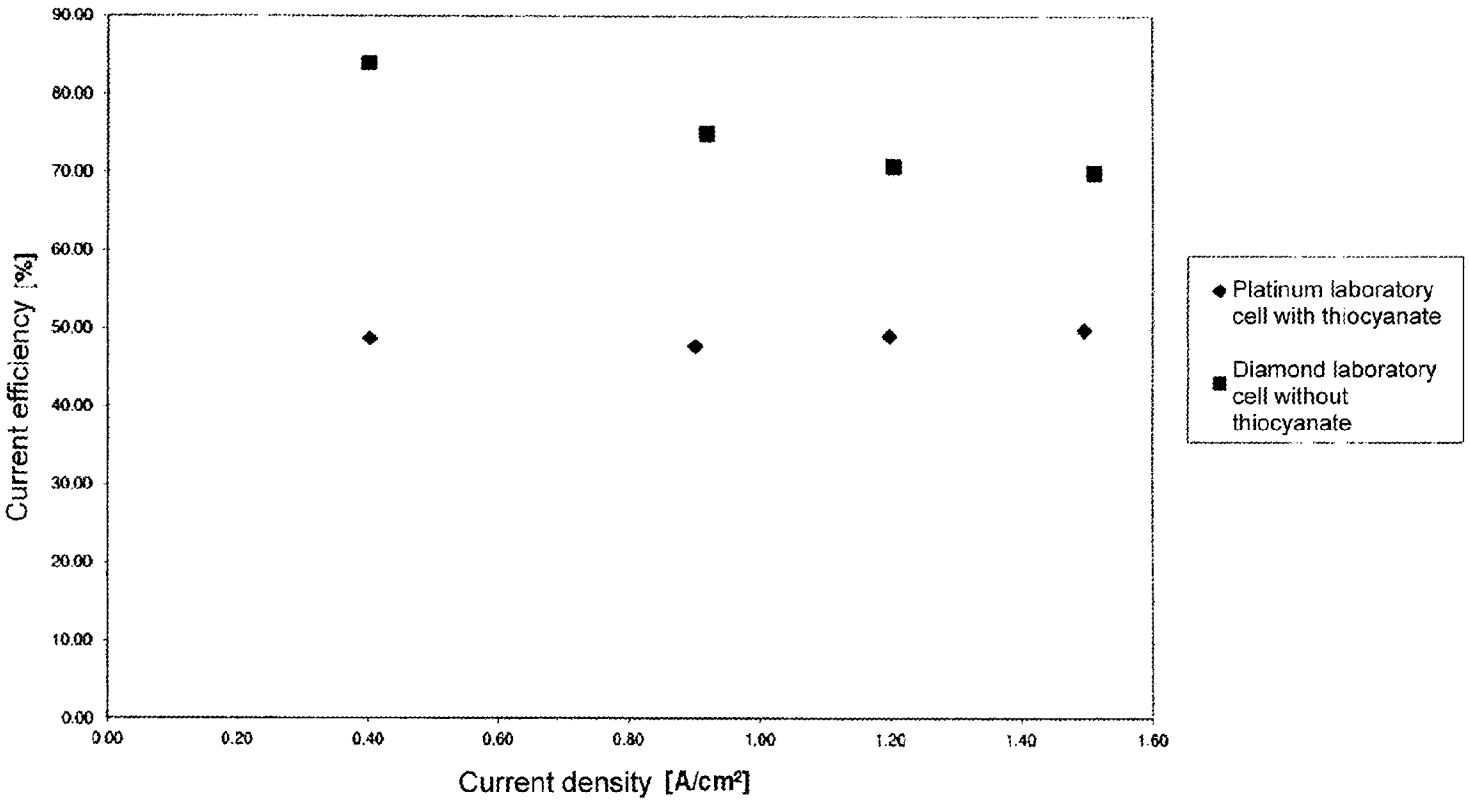

FIG. 2*b*: Current/yield in Pt/HIP and diamond electrodes

Figure 3:
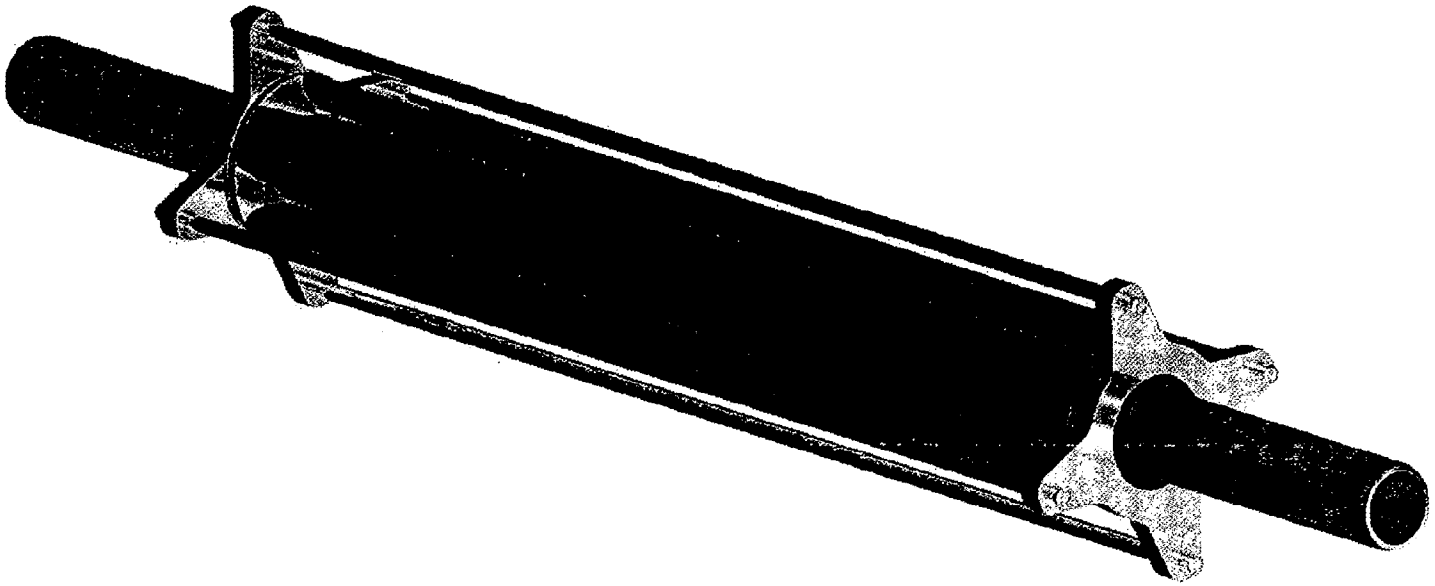

FIG. 3: Electrolytic cell according to the invention—plan view

Figure 4:
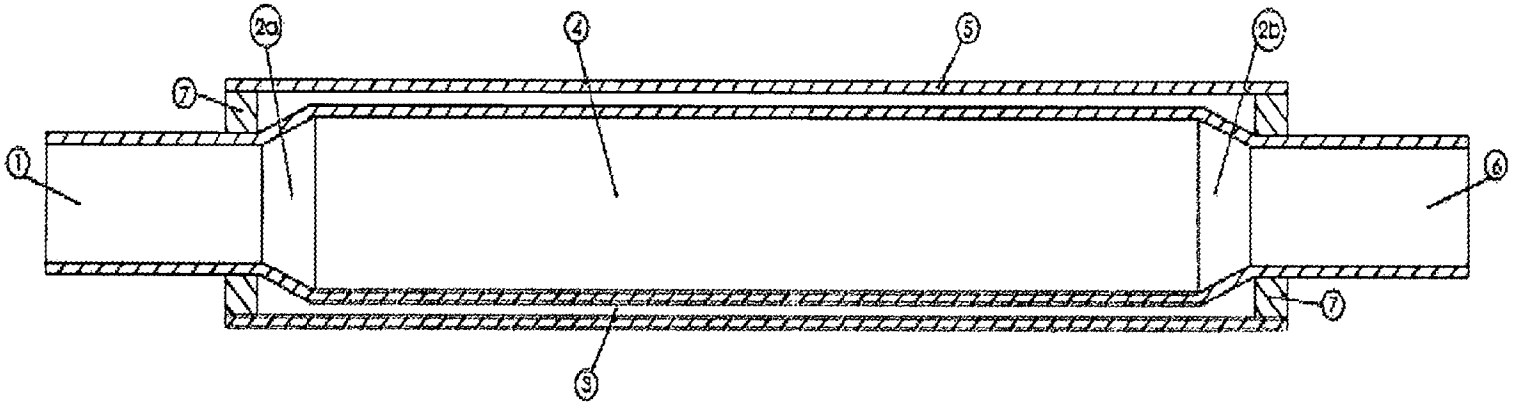

FIG. 4: Cross-section of an electrolytic cell according to the invention.

Figure 5:
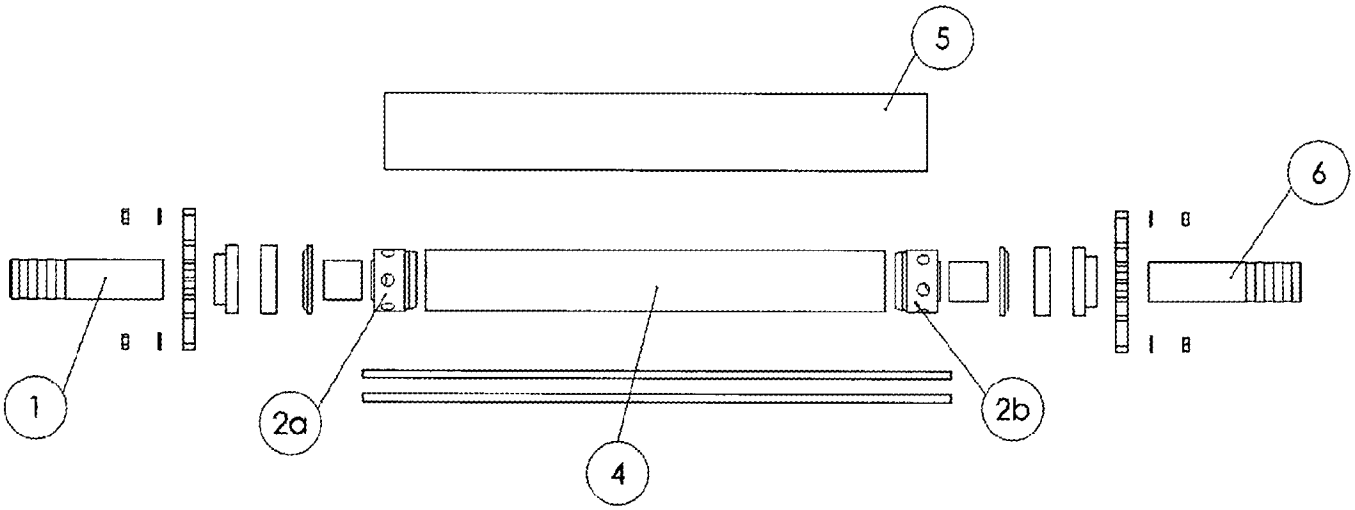

FIG. 5: Individual components of the electrolytic cell according to the invention.

Figure 6:
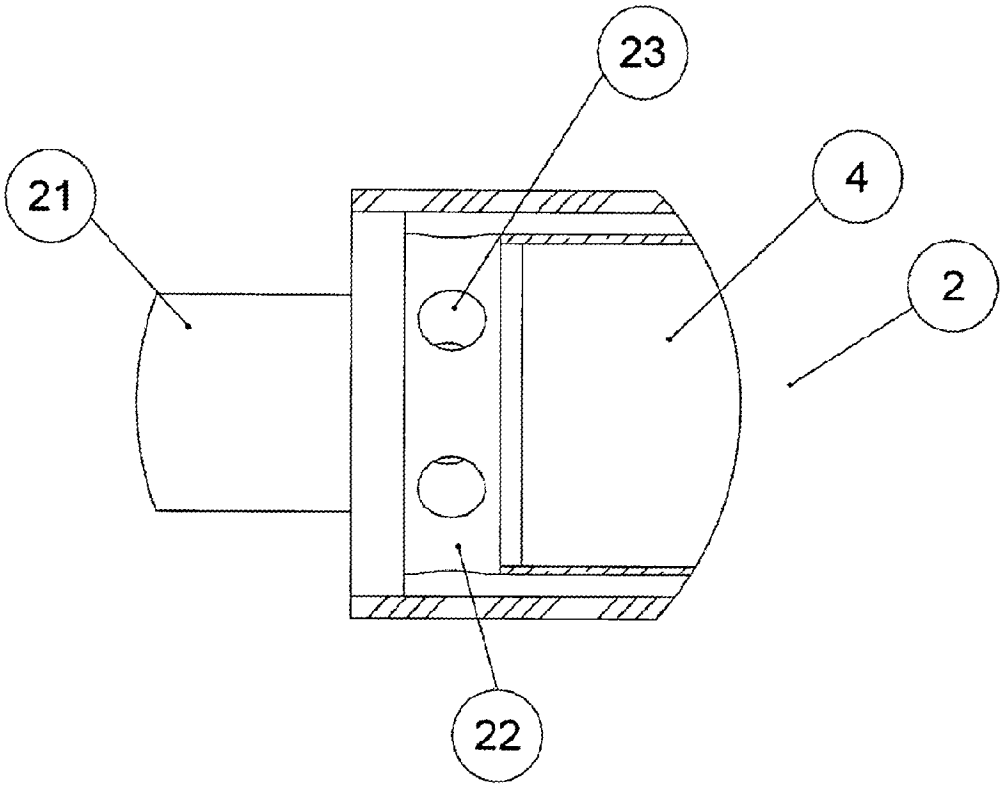

FIG. 6: Distributor device

FIG. 3 shows a possible embodiment of an electrolytic cell according to the present invention.

A cross-section of this model is shown in diagram form in FIG. 4. Through the inlet tube (1) the electrolyte enters into the distributor device (2*a*) and is fed from there in a flow-assisted manner to the electrolyte chamber (3). The electrolyte chamber (3) is formed by the annular gap between the outer surface of the anode (4) and the inner surface of the cathode (5). The electrolytic product is collected by the distributor device (2*b*) and transferred into the outflow tube (6). Seals (7) close the electrolyte chamber between the inlet and outlet tube and the inner surface of the cathode.

In a preferred embodiment, the distributor device (2) can be configured such that the distributor device simultaneously takes over the sealing of the electrolyte chamber.

FIG. 5 shows the individual components of the electrolytic cell according to the invention. The numbering is analogous to FIG. 4. Further components for sealing the electrolytic cell and for assembly are shown in FIG. 5 but are not numbered. These components are known to the person skilled in the art and can be replaced as desired.

FIG. 6 is an enlarged representation of the distributor device (2). The distributor device has a connection point (21) for an outlet or inlet tube and a connection point (22) for the anode (4). The connection point for the anode forms a hollow cylinder which ends flush with the anode tube or rod (4).

Radial bores (23) are distributed over the periphery of the hollow cylinder of the distributor device. By the radial bores (23) in the distributor device the electrolyte can be fed homogeneously into the electrolyte chamber, and can be removed effectively after passage through the electrolyte chamber. Preferably, the distributor device has 3, more preferably 4 and still more preferably 5 radial bores.

EXAMPLE

The preparation of the various peroxydisulphates takes place according to the following mechanisms:

Sodium Peroxydisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2Na^+ + S_2O_8^{2-} Na_2S_2O_8\downarrow$

Overall: $Na_2SO_4 + H_2SO_4 \rightarrow Na_2S_2O_8 + H_2\uparrow$

Ammonium Peroxydisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2NH_4^+ + S_2O_8^{2-} (NH_4)_2S_2O_8\downarrow$

Overall: $(NH_4)_2SO_4 + H_2SO_4 \rightarrow Na_2S_2O_8 + H_2\uparrow$

Potassium Peroxydisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2K^+ + S_2O_8^{2-} K_2S_2O_8\downarrow$

Overall: $K_2SO_4 + H_2SO_4 \rightarrow K_2S_2O_8 + H_2\uparrow$

The preparation according to the invention of sodium peroxydisulphate is described by way of example in the following.

On the one hand a two-dimensional and on the other hand a three-dimensional cell comprising a boron-doped niobium anode coated with diamond (diamond anode according to the invention) was used for this.

Electrolyte Starting Composition:

Temperature: 25° C.

Sulphuric acid content: 300 g/l

Sodium sulphate content: 240 g/l

Sodium persulphate content: 0 g/l

Active anode area in the cell types used:

Tubular cell with platinum-titanium anode: 1,280 $cm^2$

Tubular cell with diamond-niobium anode: 1,280 $cm^2$

Flat cell with diamond-niobium anode: 1,250 $cm^2$

Cathode material: acid-resistant high-grade steel: 1.4539

Solubility limit (sodium persulphate) of the system approx. 65-80 g/l.

Current Densities:

The electrolyte was concentrated accordingly by being circulated (see FIGS. 1 and 2).

Results:

From the course of the current efficiency as a function of the changed sodium persulphate content (FIG. 1) it can be clearly seen that over the entire operating range appropriate for this cell from approx. 100 g/l to about 350 g/l, even without addition of a promoter, the diamond anode used achieves significantly higher current efficiencies than are known for conventional platinum-coated titanium anodes with added promoter.

From the course of the current efficiency as a function of the current density in the preparation of sodium peroxydisulphate using a platinum anode (comparative examples) with the addition of a corresponding promoter and in a diamond anode which is doped with boron and is to be used according to the invention, in each case incorporated in an undivided electrolytic cell (FIGS. 2*a*+2*b*), it follows that at a current density of 100-1,500 mA/$cm^2$ a current efficiency of more than 75% can be obtained.

In contrast, however, the experiments also showed that conventional titanium anodes coated with Pt foil achieved current efficiencies of only at best 60-65% within this operating range, in spite of the addition of a sodium thiocyanate solution as a promoter. Without the addition of a promoter, on the other hand, current efficiencies of only about 35% are achieved, which the present invention confirms.

In summary, it can be confirmed that even without addition of a potential-increasing agent the current efficiency of a diamond-coated niobium anode is about 10% higher than in a cell with a conventional platinum-titanium anode and addition of a potential-increasing agent, and is about 40% higher than in a cell with a conventional platinum-titanium anode without addition of a potential-increasing agent.

The drop in voltage at a diamond-coated anode is about 0.9 volt higher than in a comparable cell with a platinum-titanium anode. It was furthermore found that the current efficiency with a diamond electrode to be used according to the invention without the addition of a promoter decreases only slowly with increasing total content of sodium peroxydisulphate in the electrolyte—under the experimental conditions, for example, at a current efficiency equal to or above 65% electrolyte solutions having a sodium peroxydisulphate content of about 400-650 g/l can be obtained.

Using a conventional platinum anode and co-using a promoter in the electrolyte, in contrast, only equally high peroxydisulphate concentrations of about 300 g/l can be obtained, and indeed at a current efficiency of about 50%.

Random investigations on a similar system with potassium ions from potassium sulphate produced similarly good results.

It is surprising to the person skilled in the art that the process according to the invention can be carried out at high conversions with current densities which are easy to handle industrially without spatial separation of the anolyte and catholyte and without the use of a promoter, with a simultaneously high current efficiency at simultaneously high persulphate and solids concentrations in undivided electrolytic cells without the addition of a promoter.

In the course of the investigations of this invention, it was found that the preparation of ammonium and essentially alkali metal peroxydisulphates with a high current efficiency is also accordingly possible in an undivided cell when a diamond thin film electrode doped with a tri- or pentavalent element is used as the anode. Surprisingly, the cell can also be employed economically appropriately at a very high solids content, essentially peroxydisulphate content, and at the same time the use of a promoter can be dispensed with completely and the electrolysis can be carried out at a high current density, resulting in further advantages, in particular with respect to installation and capital costs.

Summary:

The use of an undivided cell renders possible electrolyte solutions having very high solids concentrations, as a result of which in turn the expenditure of energy in the obtaining of the salt, essentially the crystallisation and the evaporation of water, is significantly reduced, but at least to 25% of that of a divided cell, directly proportionally to the increase in the solids content.

In spite of dispensing with the use of a promoter and therefore dispensing with the purification measures required for the electrolytic gas, higher conversions and higher persulphate concentrations can be obtained in the electrolyte sluiced out.

The operating current density can be reduced significantly compared with platinum anodes with an equally high production quantity, as a result of which less ohmic losses occur in the system and therefore the outlay on cooling is reduced and the degree of freedom in the design of the electrolytic cells and the cathodes is increased.

At the same time the current efficiency and therefore the production quantity can be increased with increasing current density.

Due to the outstanding abrasion resistance of the diamond-coated anode, very much higher flow rates can be used compared with a Pt anode built up similarly in construction.

The invention claimed is:

1. A process for the preparation of an ammonium or alkali metal peroxydisulphate, comprising:

anodic oxidation of an aqueous electrolyte comprising a salt chosen from ammonium sulphate, alkali metal sulphate and/or the corresponding hydrogen sulphate in a tubular electrolytic cell comprising at least one anode and one cathode wherein a diamond layer arranged on a conductive carrier and doped with a tri- or pentavalent element is used as the anode, the tubular electrolytic cell comprises an undivided electrolyte chamber between the anode and the cathode, and the aqueous electrolyte comprises no promoter for increasing the decomposition voltage of water to oxygen and has a total solids content of from about 0.5 to about 650 g/l.

2. The process of claim 1, wherein the alkali metal sulphate and/or the corresponding hydrogen sulphate is selected from the group consisting of sodium sulphate, potassium sulphate, sodium hydrogen sulphate, potassium hydrogen sulphate and mixtures thereof.

3. The process of claim 1, wherein the anode carrier material is selected from the group consisting of silicon, germanium, titanium, zirconium, niobium, tantalum, molybdenum, tungsten, carbides of these elements, aluminium and mixtures thereof.

4. The process of claim 1, wherein a boron-doped and/or phosphorus-doped diamond layer is used.

5. The process of claim 4, wherein the boron-doped and/or phosphorus-doped diamond layer is doped up to an extent of 10,000 ppm in the crystal structure.

6. The process of claim 1, wherein the diamond layer has a film thickness of from about 0.5 μm to about 5.0 μm.

7. The process of claim 1, wherein a boron-doped diamond layer on a niobium or titanium carrier is used as the anode.

8. The process of claim 1, wherein the cathode is formed from lead, carbon, tin, platinum, nickel, alloys of these elements, zirconium and/or acid-resistant high-grade steels.

9. The process of claim 1, wherein multiple electrolytic cells are combined.

10. The process of claim 9, wherein the multiple electrolytic cells are combined in the form of a double tube package or two-dimensionally.

11. The process of claim 1, wherein the electrolyte has an acidic or neutral pH.

12. The process of claim 1, wherein the electrolyte is moved in circulation through the electrolytic cell during the process.

13. The process of claim 12, further comprising a sluicing out of electrolyte solution from the electrolyte circulation.

14. The process of claim 12, further comprising a procedure in which the peroxydisulphates produced are obtained by crystallisation and separating off of the crystals from the electrolyte solution to form an electrolyte mother liquor.

15. The process of claim 14, further comprising a recirculation of the electrolyte mother liquor, to increase the content of acid, sulphate and/or hydrogen sulphate in the electrolytic cell.

16. The process of claim 4, wherein the anodic oxidation is carried out at an anodic current density of from about 50 to about 1,500 mA/cm$^2$.

17. The process of claim 1, wherein the electrolyte comprises about 100 to about 500 g/1 of persulphate.

18. The process of claim 1, wherein the electrolyte comprises about 0.1 to about 3.5 mol of sulphuric acid per 1 of electrolyte solution.

19. The process of claim 1, wherein the diamond layer has a film thickness of from about 0.8 μm to about 2.0 μm.

20. The process of claim 1, wherein the diamond layer has a film thickness of about 1.0 μm.

21. The process of claim 1, wherein the anodic oxidation is carried out at an anodic current density of from about 250 to about 1,350 mA/cm$^2$.

22. The process of claim 1, wherein the anodic oxidation is carried out at an anodic current density of from about 400 to about 1200 mA/cm$^2$.

* * * * *